US009308541B2

(12) United States Patent
Uehria et al.

(10) Patent No.: US 9,308,541 B2
(45) Date of Patent: Apr. 12, 2016

(54) PUMP-DISPENSING CONTAINER

(71) Applicant: Daiwa Can Company, Chiyoda-ku, Tokyo (JP)

(72) Inventors: Shoji Uehria, Sagamihara (JP); Tomoko Okada, Sagamihara (JP); Kazuya Abe, Sagamihara (JP); Osamu Yoshida, Sagamihara (JP)

(73) Assignee: Daiwa Can Company, Tokyo (JP)

( * ) Notice: Subject to any disclaimer, the term of this patent is extended or adjusted under 35 U.S.C. 154(b) by 21 days.

(21) Appl. No.: 14/376,926

(22) PCT Filed: Feb. 7, 2013

(86) PCT No.: PCT/JP2013/052851

§ 371 (c)(1),
(2) Date: Aug. 6, 2014

(87) PCT Pub. No.: WO2013/118816

PCT Pub. Date: Aug. 15, 2013

(65) Prior Publication Data

US 2015/0001254 A1 Jan. 1, 2015

(30) Foreign Application Priority Data

Feb. 9, 2012 (JP) ..... 2012-025857

(51) Int. Cl.
*B65D 88/54* (2006.01)
*B05B 11/00* (2006.01)
*B05B 7/00* (2006.01)

(52) U.S. Cl.
CPC ..... *B05B 11/3001* (2013.01); *B05B 7/0037* (2013.01); *B05B 11/3073* (2013.01);
(Continued)

(58) Field of Classification Search
CPC ..... B05B 11/3001; B05B 11/3073; B05B 11/3014; B05B 11/3019; B65D 88/54
USPC ..... 222/190, 321.1, 321.7, 321.9, 384, 222/153.13; 239/333
See application file for complete search history.

(56) References Cited

U.S. PATENT DOCUMENTS 4,887,744 A * 12/1989 Williams ..... B67D 1/0456 222/153.13
5,025,956 A * 6/1991 Linsenbigler ..... B05B 11/3001 222/153.13

(Continued)

FOREIGN PATENT DOCUMENTS

EP 1980329 A2 10/2008
JP 2002-011390 1/2002

(Continued)

OTHER PUBLICATIONS

International Search Report dated Apr. 9, 2013 filed in PCT/JP2013/052851.

(Continued)

*Primary Examiner* — Paul R Durand
*Assistant Examiner* — Andrew P Bainbridge
(74) *Attorney, Agent, or Firm* — Rankin, Hill & Clark LLP

(57) ABSTRACT

The object of the present invention is to improve a pump-dispensing container structured to prevent leakage of liquid caused by slight vertical movements of the nozzle head, to make it easier to push out the liquid when the nozzle head is pressed down first from its highest position.

If a primary check valve is configured to open the connection between the inside of the liquid chamber and the inside of the container body in a state in which the liquid chamber is filled with a liquid and the nozzle head is raised to its highest position, when the nozzle head is pressed down from its highest position to push out the liquid, resistance met during the pressing down of the nozzle head is significantly reduced because of the open connection between the inside of the liquid chamber and the inside of the container body, and the liquid can be pushed out easily by applying a small force.

8 Claims, 7 Drawing Sheets

First embodiment of the present invention
(with a polypropylene-resin ball valve)

(52) U.S. Cl.
CPC ..... *B05B11/3087* (2013.01); *B05B 11/0064* (2013.01); *B05B 11/3014* (2013.01); *B05B 11/3019* (2013.01)

(56) References Cited

U.S. PATENT DOCUMENTS

| | | | | |
|---|---|---|---|---|
| 8,496,142 | B2 * | 7/2013 | Uehira | B05B 11/0064 222/190 |
| 2008/0251540 | A1 | 10/2008 | Oh | |
| 2009/0008412 | A1 | 1/2009 | Oh | |
| 2009/0020552 | A1 | 1/2009 | van der Heijden | |

FOREIGN PATENT DOCUMENTS

| | | |
|---|---|---|
| JP | 2003-321048 | 11/2003 |
| JP | 2004-217283 | 8/2004 |

OTHER PUBLICATIONS

Extended European Search Report dated Oct. 7, 2015 issued in the corresponding European patent application No. 13746052.3.

* cited by examiner

Third embodiment of the present invention
(with a stainless-steel valve working together with a tublar engagement part)

PUMP-DISPENSING CONTAINER

RELATED APPLICATIONS

This application claims the benefits of priority from Japanese Patent Application No. 2012-25857, dated Feb. 9, 2012, the contents of which are hereby incorporated by reference into this application.

FIELD OF THE INVENTION

The present invention relates to pump-dispensing containers, and more specifically, to improvement of the usability of a pump-dispensing container that prevents leakage of liquid caused by slight vertical movements of a nozzle during transportation or the like.

BACKGROUND OF THE INVENTION

Conventionally known pump-dispensing containers discharge a liquid contained in a container body from a discharge opening at the tip of a nozzle head disposed hi the upper part of the container body when the nozzle head is moved up and down. That type of pump-dispensing container usually has a liquid chamber (a gap between a cylinder and a piston) in a dispensing pump body and has a primary check valve and a secondary check valve respectively at the upstream end (on the container body side) and at the downstream end (on the discharge opening side) of the liquid chamber. When the nozzle head is raised, the secondary check valve is closed to depressurize the liquid chamber, and the depressurization opens the primary check valve, through which the liquid in the container body flows into the liquid chamber. When the nozzle is lowered, the liquid chamber is pressurized with the primary check valve kept closed, and the pressurization opens the secondary check valve, through which the liquid that has filled the liquid chamber is discharged from the discharge opening.

The secondary check valve that opens and closes the exit of the liquid chamber as the piston is lowered together with the nozzle head is generally designed, in that type of pump-dispensing container, to open immediately when the nozzle head is pressed down, and a slight press on the nozzle head opens the secondary check valve at the exit of the liquid chamber, causing the liquid to leak from the liquid chamber to the outside. Even if the pump-dispensing container is equipped with an over-cap or a stopper, for example, to prevent the nozzle head from being lowered from its highest position, when the containers contained in a carton box are placed upside down by mistake during transportation, the nozzle head may move up and down slightly due to vibration caused by uneven road surfaces and the like. In the container placed upside down by mistake, the primary check valve, which includes a ball valve, would be opened by gravity, and the liquid in the container body would flow into the liquid chamber. If vibrations during transportation move the nozzle head up and down further, causing the secondary check valve at the exit of the liquid chamber to open slightly, the liquid that has flown into the liquid chamber would leak from the discharge opening and would stain the containers in the carton box. There has been another problem that, when a pump-dispensing container in use is carried with its nozzle head placed in its highest position, only a slight vertical movement of the nozzle head would cause unintentional leakage of liquid, and extreme care should be used.

The present applicant has recently addressed those problems by proposing a pump-dispensing container in which a part supporting the lower end of a spring for pushing the piston upward can move up and down within a given range with respect to a cylinder, so that the secondary check valve will not be opened immediately when the nozzle head which has been placed in its highest position is lowered slightly (refer to Patent Literature 1). The secondary check valve that opens and closes the exit of the liquid chamber in the pump-dispensing container is usually configured to open when the spring is compressed; in the pump-dispensing container in Patent Literature 1, the part supporting the lower end of the spring is configured to allow a slight downward movement while the nozzle head is in its highest position. Accordingly, even if the nozzle head is moved slightly downward from the highest position, the spring does not start being compressed before the spring support comes into contact with the cylinder, or the top dead point (position where the spring starts being compressed) of the pump is reached. The secondary check valve will not open immediately, and consequently, unintentional leakage of liquid during transportation or the like can be avoided.

CITATION LIST

Patent Literature

Patent Literature 1: Japanese Unexamined Patent Application Publication No. 2004-217283

DISCLOSURE OF THE INVENTION

Problem to be Solved by the Invention

The pump-dispensing container in Patent Literature 1 has different problems: If the nozzle head is brought up further from the top dead point of the pump in some occasions, such as when the user carries the container with the nozzle head in his hand or when the stopper is attached again, for example, a large force is needed at the beginning when the nozzle head is lowered again to push out the liquid, making it difficult to push out the liquid; and after a large force is applied at the beginning to lower the nozzle head to push out the liquid, resistance drops sharply when the nozzle head is further lowered, making it difficult to control the amount of liquid to be discharged by adjusting the distance by which the nozzle head is lowered.

In view of the problems in the conventional technology, an object of the present invention is to improve a pump-dispensing container structured to prevent leakage of liquid caused by slight vertical movements of the nozzle head, to make it easier to push out the liquid when the nozzle head is pressed down first from its highest position.

Means to Solve the Problem

As a result of diligent study in view of the problems in the conventional technology, the inventors have achieved the present invention by finding that, in a pump-dispensing container structured to prevent leakage of liquid caused by slight vertical movements of the nozzle, if a primary check valve is configured to open the connection between the inside of the liquid chamber and the inside of the container body in a state in which the liquid chamber is filled with a liquid and the nozzle head is raised to its highest position, when the nozzle head is pressed down from its highest position to push out the liquid, resistance met during the pressing down of the nozzle head is significantly reduced because of the open connection between the inside of the liquid chamber and the inside of the container body, and the liquid can be pushed out easily by applying a small force.

A pump-dispensing container according to the present invention includes a container body and a dispensing pump body mounted on the opening of the container body. The pump-dispensing container discharges a liquid contained in the container body from a discharge opening provided in a nozzle head portion disposed in the upper part of the dispensing pump body when the nozzle head portion is moved up and down. The dispensing pump body includes: a tubular liquid cylinder portion which can be connected to the inside of the container body; a primary check valve which can open and close the connection between the liquid cylinder portion and the inside of the container body; a liquid piston portion which is a tubular member that can be moved up and down together with the nozzle head portion, the outer surface of the lower end being in sliding contact with the inner wall of the liquid cylinder portion, a space enclosed together with the liquid cylinder portion being provided as a liquid chamber, and the liquid piston portion being able to be connected to the inside of the nozzle head portion through an upper open end; a rod-shaped valve body which is a rod-shaped member disposed in the space enclosed by the liquid cylinder portion and the liquid piston portion, the upper end penetrating the upper open end of the liquid piston portion, the penetrated upper end having an enlarged-diameter portion having an outer diameter larger than the diameter of the open end of the liquid piston portion, and the rod-shaped valve body forming a secondary check valve which can open and close the connection between the inside of the liquid piston portion and the inside of the nozzle head portion by blocking the open end with the enlarged-diameter portion in contact with the open end of the liquid piston portion or by releasing the open end by separating the enlarged-diameter portion and the open end; a tubular engagement portion which is a tubular member engaging with the lower end of the rod-shaped valve body from the outer side, the lower face of an enlarged-diameter portion that extends outward in the lower end of the tubular member being able to be in contact with the upper face of a base portion extending inward from the edge of the bottom of the liquid cylinder portion; a spring portion which comes between the lower end of the liquid piston portion and the upper face of the enlarged-diameter portion of the tubular engagement portion and exerts force in a direction in which the distance between the liquid piston portion and the tubular engagement portion is increased; and a tubular nozzle head portion which has a discharge opening in the end and which can be connected to the inside of the liquid piston portion through the upper open end. When the nozzle head portion is brought up further above the top dead point, where the coil spring starts being compressed by moving down the nozzle head portion, the liquid piston portion, the spring portion, and the tubular engagement portion are brought up together with the nozzle head portion, and the lower face of the enlarged-diameter portion of the tubular engagement portion is separated from the upper face of the base portion on the edge of the bottom of the liquid cylinder portion, providing a given distance between the lower face of the enlarged-diameter portion and the upper face of the base portion on the edge of the bottom, and allowing the tubular engagement portion to move up and down in a given range with respect to the liquid cylinder portion. The primary check valve releases the connection between the liquid cylinder portion and the inside of the container body in the state in which the liquid chamber is filled with a desired liquid and the nozzle head portion is brought up to its highest position.

In the pump-dispensing container, it is preferred that the primary check valve includes a ball having an apparent specific gravity lower than 1.00 and a valve seat portion provided in the liquid cylinder portion and having a smaller diameter than the ball.

In the pump-dispensing container, it is preferred that the ball used in the primary check valve be a ball made of a resin having a specific gravity lower than 1.00.

In the pump-dispensing container, it is preferred that the ball used in the primary check valve is made of a resin chosen from among polyethylene, polypropylene, and ethylene-vinyl acetate copolymer.

In the pump-dispensing container, it is preferred that a ball catch portion is provided to prevent the ball from rising.

In the pump-dispensing container, it is preferred that the primary check valve includes a membrane valve body disposed in the enlarged-diameter portion in the lower end of the tubular engagement portion, and the base portion on the edge of the bottom of the liquid cylinder portion.

In the pump-dispensing container, it is preferred that the primary check valve includes a ball and a valve seat portion provided in the enlargement-diameter portion in the lower end of the tubular engagement portion and having a smaller diameter than the ball.

Effect of the Invention

In a pump-dispensing container according to the present invention, structured to prevent leakage of liquid caused by slight vertical movements of the nozzle, since the primary check valve is configured to release the connection between the inside of the liquid chamber and the inside of the container body in the state in which the liquid chamber is filled with a liquid and the nozzle head is raised to its highest position, when a force is applied to press down the nozzle head from its highest position to push out the liquid, resistance met in pressing down the nozzle head is significantly reduced because the connection between the inside of the liquid chamber and the inside of the container body has been released, and the liquid can be discharged easily by applying a small force.

DESCRIPTION OF REFERENCE NUMBERS

Figure 1:
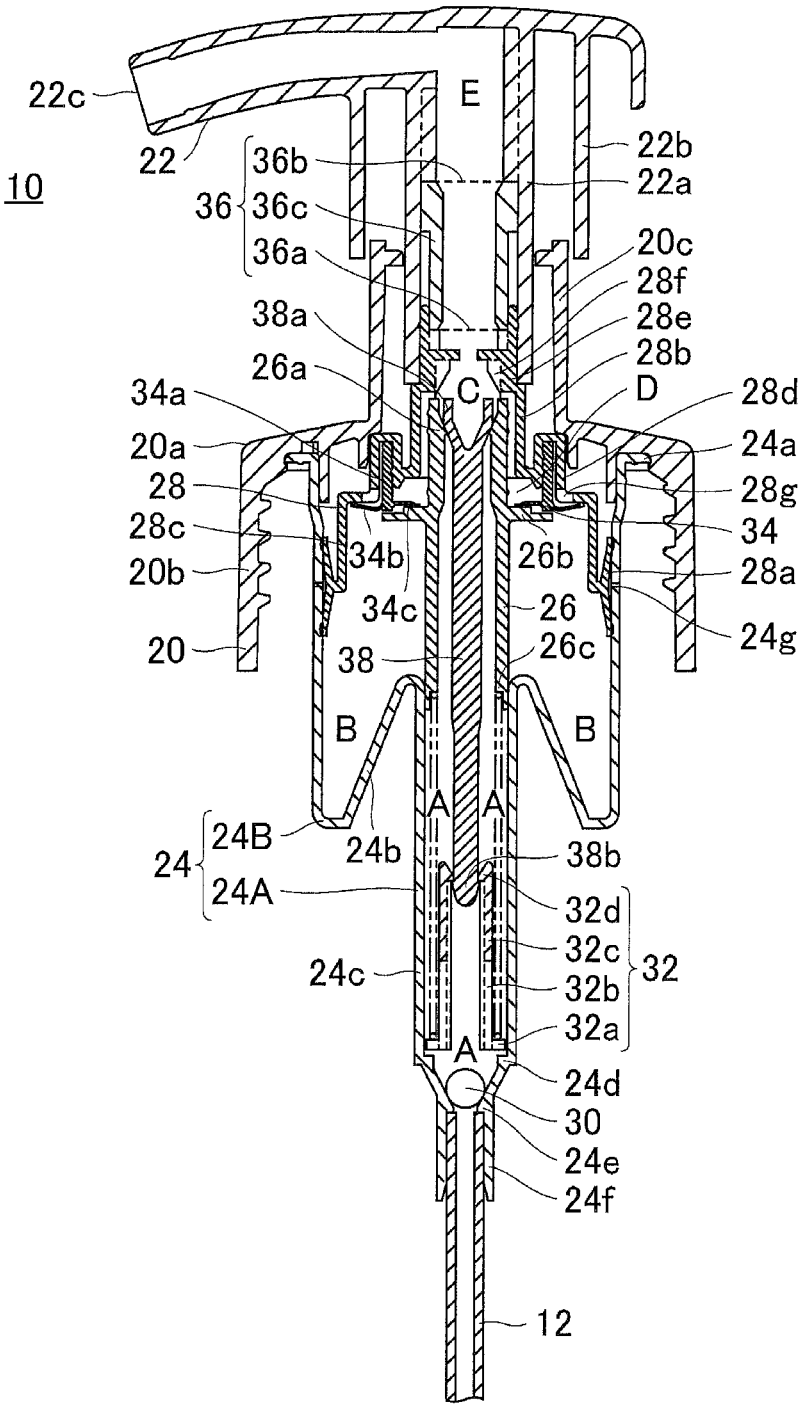
FIG. 1 is a sectional view (sectional front view) of a dispensing pump body 10 of a pump-dispensing container according to a first embodiment of the present invention (with the nozzle head in its factory-set highest position).

10: Dispensing pump body
12: Tube body
20: Base cap portion
22: Nozzle head
24: Double cylinder (24A: Liquid cylinder, 24B: Air cylinder)
26: Liquid piston
28: Air piston
30: Ball valve
32: Tubular engagement part
34: Elastic valve body
36: Porous material holder
38: Rod-shaped valve body

BEST MODE FOR CARRYING OUT THE INVENTION

Preferred embodiments of the present invention will be described next with reference to the drawings. Pump-dispensing containers in the embodiments described below are foam dispensing containers which mix air and a foaming liquid in the container and push it out in the form of foam, but the present invention is not limited to those types of foam dispensing containers and also relates to foam dispensing containers that push the liquid out of the container body.

Structure of Pump-Dispensing Container

The pump-dispensing container according to this embodiment includes a container body which contains a liquid, a dispensing pump body which is detachably mounted on the opening at the upper end of the container body, and a tube body which is connected to the dispensing pump body and extends to the inside of the container body.

FIG. 1 is a sectional view (sectional front view) of a dispensing pump body 10 according to a first embodiment of the present invention (with the nozzle head in its factory-set highest position).

A skirt-like base cap portion 20 disposed in the lower part of the dispensing pump body 10 according to this embodiment has an internal thread formed on its inner periphery. The opening (not shown) of the container body which contains a foaming liquid has an external thread on its outer periphery, the external thread being engaged with the internal thread on the base cap portion 20 to mount the dispensing pump body 10 detachably on the container body.

The major components of the dispensing pump body 10 according to this embodiment includes the base cap portion 20, a nozzle head 22, which functions as an operating portion and a discharge portion, a double cylinder 24 which includes a liquid cylinder 24A and an air cylinder 24B, a liquid piston 26, and an air piston 28. These components are usually made of a synthetic resin material. For example, a single material, such as polypropylene (PP); a polyolefin-based resin such as high-density polyethylene (HDPE), medium-density polyethylene (MDPE), or low-density polyethylene (LDPE); or a polyester-based resin such as polyethylene terephthalate (PET), or a mixture of those materials can be used.

The specific structures of the components of the dispensing pump body 10 will be described next.

The double cylinder 24 is integrally formed from a synthetic resin as a single component by injection molding or the like. The double cylinder 24 has the large-diameter air cylinder 24B and the small-diameter liquid cylinder 24A, which are disposed concentrically and formed integrally. The air cylinder 24B has an annular flange portion 24*a* formed in the open edge portion of the upper end, the flange portion being placed on the top end of the opening of the container body.

The air cylinder 24B of the double cylinder 24 has a tubular part extending from the flange portion 24*a*, the tubular part including a short large-diameter part having an outer diameter slightly smaller than or equivalent to the inner diameter of the opening portion of the container body and a uniform-diameter cylinder wall having an inner diameter slightly smaller than the large-diameter part. From the lower end of the cylinder wall of the air cylinder 24B, a coupling portion 24*b* rises and extends inward in a radial direction.

The upper end of the liquid cylinder 24A of the double cylinder 24 is connected to the radially inner end of the coupling portion 24*b* and extends downward from the coupling portion 24*b*. An annular base portion 24*d* is formed at the lower end of the cylindrically-shaped cylinder wall 24*c*, the coupling portion 24*b* supporting the lower end of a tubular engagement part 32, which will be described later. A funnel-shaped ball-valve seat portion 24*e* which becomes a seat portion for a ball valve 30 is formed below the base portion 24*d*. A cylindrically-shaped lower tubular portion 24*f*, into which a tube body 12 for guiding the foaming liquid from the inside of the container body to the inside of the liquid cylinder 24A is press-fitted, is formed below the seat portions 24*e*. The tube body 12 press-fitted into the lower tubular portion 24*f* extends to the vicinity of the bottom inside the container body.

The air piston 28 and the liquid piston 26 are formed from a synthetic resin as separate components by injection molding or the like and are then coupled concentrically to form a single piston body. They are disposed in the double cylinder 24 such that a sliding seal portion 28*a* of the air piston 28 slides on the inner surface of the cylinder wall of the air cylinder 24B and such that a sliding seal portion 26*c* of the liquid piston 26 slides on the inner surface of the cylinder wall 24*c* of the liquid cylinder 24A. The nozzle head 22 is coupled to the upper end of the air piston 28.

The air piston 28 has an upper small-diameter portion 28*b* in its axial part and a lower large-diameter portion 28*c* disposed concentrically with the upper small-diameter portion 28*b*, those portions being formed integrally through a middle coupling portion 28*d*. The middle coupling portion 28*d* is formed on the radially internal side from the upper end of the lower large-diameter portion 28*c*, and the upper small-diameter portion 28*b* rises from the inner edge portion of the middle coupling portion 28*d*. A reduced-diameter portion 28*e* having slightly smaller inner diameter is disposed at the upper end of the upper small-diameter portion 28*b*, and the reduced-diameter portion 28*e* has vertical ribs 28*f* formed radially on its inner face. The vertical ribs 28*f* are structured as a slope with its lower face inclined outward. The lower large-diameter portion 28*c* has an integrally formed sliding seal portion 28*a* at its lower end such that the sliding seal portion 28*a* allows sufficient air tightness to be secured with the inner face of the cylinder wall of the air cylinder 24B and also allows vertical sliding on the inner face of the air cylinder 24B.

The entire liquid piston 26 has an approximately cylindrical shape, and a funnel-shaped liquid-chamber valve seat member 26*a* whose inner diameter increases toward the top is formed inside the upper end of the axial hollow portion of the liquid piston 26. At the lower end of the liquid piston 26, a sliding seal portion 26*c* is formed to slide up and down on the inner face of the cylinder wall 24*c* of the liquid cylinder 24A in an airtight state. An annular flat portion is formed inside the sliding seal portion 26*c* to support the upper end of a coil spring, which will be described later.

The air piston 28 and the liquid piston 26 are integrally coupled to form a single piston body when the upper end of the liquid piston 26 is press-fitted to the inside of the lower part of the upper small-diameter portion 28*b* of the air piston 28. The integrated piston bodies 26 and 28 are mounted on the double cylinder 24 such that they can move up and down integrally, by inserting the air piston 28 into the air cylinder 24B and by inserting the liquid piston 26 into the liquid cylinder 24A.

The coil spring (represented by a dashed line in FIG. 1) is disposed between the vicinity of the lower end of the liquid piston 26 and an annular support 32*a* formed at the lower end of the tubular engagement part 32, which will be described later. The spring force of the coil spring is always applied in the direction in which the distance between the liquid piston 26 and the tubular engagement part 32 is widened.

In the structure of the container described above, a space inside the liquid cylinder 24A and the liquid piston 26 is formed as a liquid chamber A, and a space enclosed by the air cylinder 24B, the air piston 28, and the liquid piston 26 is formed as an air chamber B. In addition, a space enclosed by the upper end of the liquid piston 26, the upper part of the air piston 28, a catch portion 38*a* in the end of a rod-shaped valve body 38, which will be described later, and a porous material holder 36 is formed as a mixing chamber C. A space enclosed by the outer face of the upper part of the liquid piston 26 and the inner face of the lower part of the upper small-diameter portion 28*b* of the air piston 28 is provided as an air passage D through which air is sent from the air chamber B to the mixing chamber C.

The inner face of the lower part of the upper small-diameter portion 28*b* of the air piston 28 works as a fitting portion of the liquid piston 26. The outer face of the upper part of the liquid piston 26 has a plurality of vertical grooves formed in the radial direction in the position corresponding to the fitting portion. The grooves form the air passage D between the outer face of the upper part of the liquid piston 26 and the inner face of the air piston 28.

In the part corresponding to the fitting portion on the outer face of the upper part of the liquid piston 26, vertical ribs are provided to form the vertical grooves. The outer diameter of a virtual circle connecting the outer face of the vertical ribs is made approximately equal to the inner diameter of the upper small-diameter portion 28*b* of the air piston 28 so that the piston can be press-fitted into the upper small-diameter portion 28*b* of the air piston 28. The vertical grooves or the vertical ribs provided to form the air passage D may be disposed on the inner face of the air piston 28 instead of the part corresponding to the fitting portion on the outer face of the upper part of the liquid piston 26.

The side wall of the nozzle head 22 coupled to the air piston 28 is a double wall that includes an inner tubular portion 22*a* and an outer tubular portion 22*b*, and an L-shaped through hole that passes through the inside of the inner tubular portion 22*a* and that has a bent upper end provides a foam passage E. In the downstream end of the foam passage E, a discharge opening 22*c* is provided to discharge foam to the outside. By putting the base cap portion 20 on the top of the double cylinder 24 on which the air piston 28 and the liquid piston 26 are mounted and then fitting the top end of the reduced-diameter portion 28*e* of the air piston 28 into the lower end of the inner tubular portion 22*a* of the nozzle head 22 and securing it there, the nozzle head 22, the air piston 28, and the liquid piston 26 are integrally coupled, and the mixing chamber C formed inside the upper part of the reduced-diameter portion 28*e* of the air piston 28 is connected to the foam passage E formed inside the nozzle head 22.

The foam passage E in the nozzle head 22 meets the porous material holder 36 disposed on the downstream side of the mixing chamber C before it is coupled to the air piston 28, the porous material holder 36 including porous sheets 36*a* and 36*b* stretched at both ends thereof. The porous material holder 36 may be configured such that the porous sheets 36*a* and 36*b* are nets formed by weaving synthetic-resin threads and are fused on both ends of a cylindrical synthetic-resin spacer 36*c*. It is preferred, in terms of foam quality, that the porous sheet 36*b* on the downstream side (close to the discharge opening 22*c*) has a finer network than the porous sheet 36*a* on the upstream side (close to the mixing chamber C).

The base cap portion 20 and the opening portion of the container body secure the dispensing pump body 10 between them, and the base cap portion 20 includes a top wall portion 20*a* having an opening in its center, a skirt portion 20*b* suspended from the outer peripheral edge of the top wall portion 20*a*, and an upright wall 20*c* rising from the open edge of the top wall portion 20*a*. An annular cylindrical portion which comes into contact with the inner face of the flange portion 24*a* of the air cylinder 24B and another cylindrical portion having a smaller diameter are suspended from the lower face of the top wall portion 20*a*. The skirt portion 20*b* of the base cap portion 20 has an internal thread on its inner periphery, which is engaged with the external thread formed on the outer periphery of the opening of the container body, to cap the opening of the container body with the base cap portion 20.

Primary Check Valve

In the dispensing pump body 10 of the first embodiment of the present invention, the ball valve 30 is placed on the approximately-funnel-shaped ball-valve seat portion 24*e* near the lower end of the liquid cylinder 24A, and the valve seat portion 24*e* and the ball valve 30 form a primary check valve.

The ball valve 30 in the dispensing pump body 10 according to the first embodiment is made of a polypropylene resin with a specific gravity of 0.90 to 0.91. Since the liquid chamber A of a factory-assembled pump-dispensing container is not filled with a liquid, the ball valve 30 is in contact with the valve seat portion 24*e* because of gravity, as shown in FIG. 1, and the connection between the inside of the liquid chamber A and the tube body 12 is blocked. On the other hand, since general liquid preparations have a specific gravity of 1.00 or higher, when the liquid chamber A is filled with a liquid preparation by vertical movements of the nozzle head, the ball valve 30, having a lower specific gravity than the liquid preparation, is brought upward by buoyancy and is not brought into contact with the valve seat portion 24*e*, and the connection between the inside of the liquid cylinder 24A and the tube body 12 is left open.

When the nozzle head 22 is further pressed to a position lower than the position where the coil spring starts being compressed (the top dead point of the pump) while the liquid chamber A is filled with a liquid, the liquid in the liquid chamber A flows back toward the container body, the pressure of the liquid (pressure exceeding the buoyancy of the ball valve 30) is applied to the ball valve 30 in the inside of the liquid cylinder 24A, and the ball valve 30 is brought down and comes into contact with the valve seat portion 24*e*, blocking the connection between the inside of the liquid chamber A and the tube body 12. The vertical movement of the nozzle head 22 pressurizes the liquid inside the liquid chamber A, thereby controlling the connection between the inside of the liquid chamber A and the tube body 12, and the primary check valve is structured in that way in the dispensing pump body 10 according to the first embodiment.

Although the dispensing pump body 10 according to the first embodiment uses a ball valve made of a polypropylene resin with a specific gravity of 0.90 to 0.91 as the ball valve 30, a ball having an apparent specific gravity lower than 1.00 would produce the same effect as in this embodiment when a ball valve is used as the primary check valve because general liquid preparations have a specific gravity of 1.00 or higher. The apparent specific gravity here is the value obtained by taking the value obtained by dividing the mass of a substance by the volume of the substance, and dividing that value by the density of water, which is a reference material. If the ball made of a resin, stainless steel, or another material having a specific gravity of 1.00 or higher has a hollow structure or the like to bring the apparent specific gravity to lower than 1.00, the ball will be lifted by buoyancy in general liquid preparations and will produce the same effect as in this embodiment. A solid ball made of a resin with a specific gravity of lower than 1.00 is preferred in terms of cost and ease of production. Resins with a specific gravity of lower than 1.00 include polyethylene (specific gravity of 0.91 to 0.97) and ethylene-vinyl acetate copolymer (specific gravity of 0.92 to 0.95), for example. The shape of the valve is not limited to that of the ball valve, and cone-shaped, rod-shaped, film-shaped, and other known check valves can be used. However, the primary check valve must be open when the inside of the liquid chamber A is filled with a liquid and when the nozzle head 22 is raised to its highest position.

Alternatively, even if the material does not have such a low specific gravity as that in the first embodiment, a valve structure working with a tubular engagement part can also leave the primary check valve open when the inside of the liquid chamber A is filled with a liquid and when the nozzle head 22 is raised to its highest position.

Figure 4:
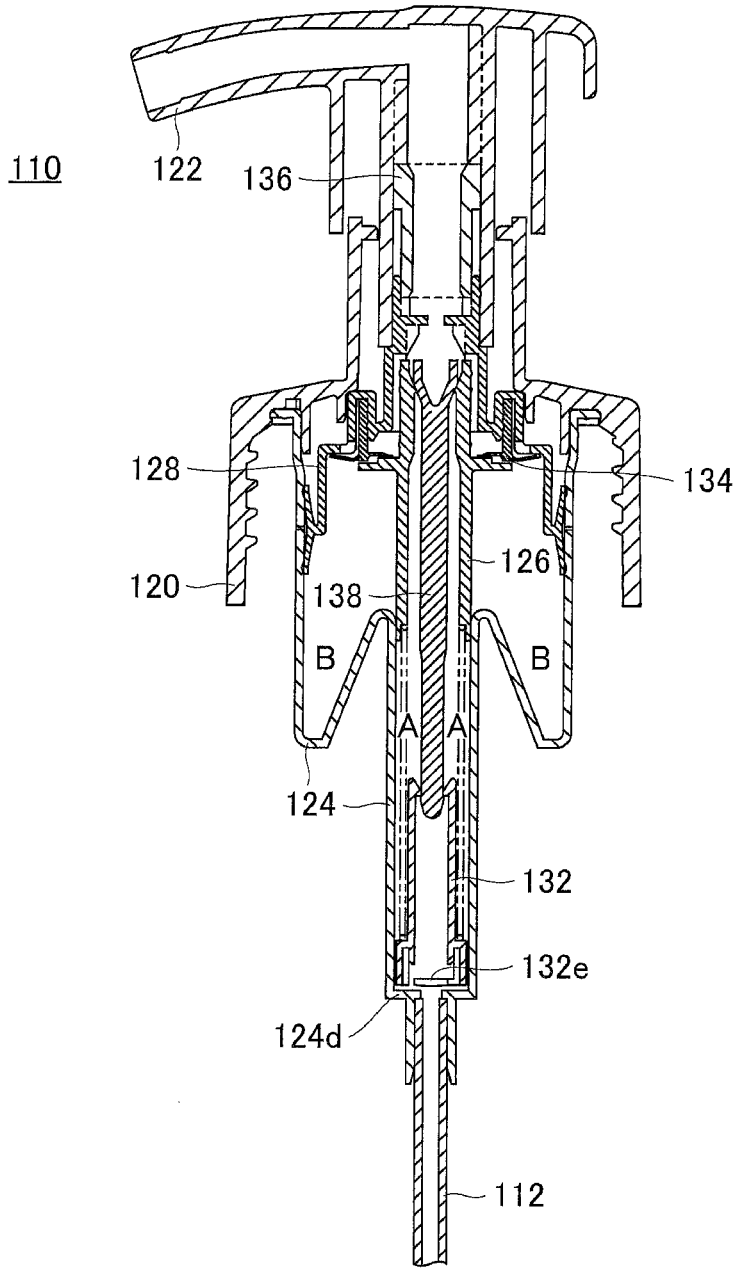
FIG. 4 is a sectional view (sectional front view) of a dispensing pump body 110 of a pump-dispensing container according to a second embodiment of the present invention (with the nozzle head in its factory-set highest position).
Figure 5:
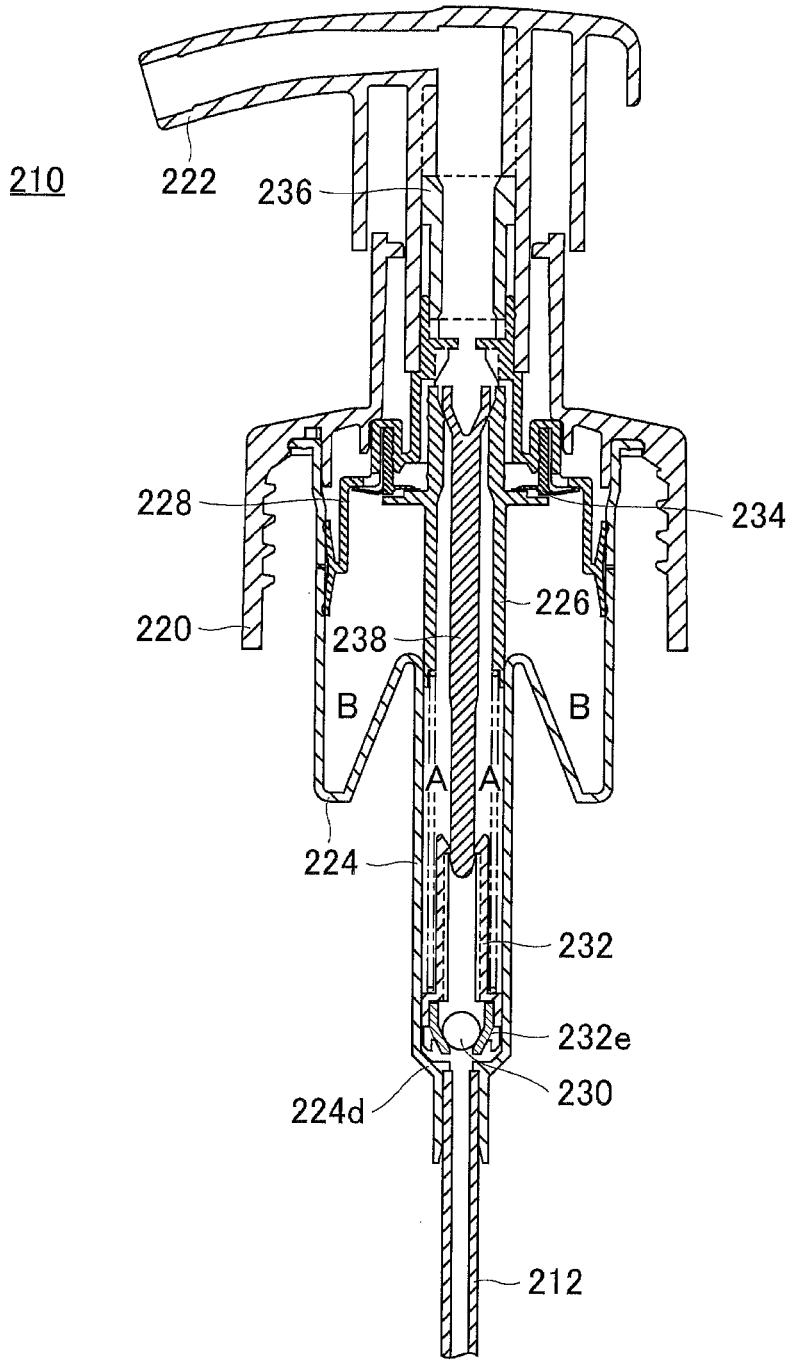
FIG. 5 is a sectional view (sectional front view) of a dispensing pump body 210 of a pump-dispensing container according to a third embodiment of the present invention (with the nozzle head in its factory-set highest position).

FIGS. 4 and 5 respectively show sectional views of a dispensing pump body 110 according to a second embodiment of the present invention and a dispensing pump body 210 according to a third embodiment of the present invention, in which the valve structure of the primary check valve differs from that in the first embodiment. In the second and third embodiments, the components other than the primary check valve are the same as those in the first embodiment, and a description of those components will be omitted.

The dispensing pump body 110 in the second embodiment has a membrane valve body 132*e* in an enlarged-diameter portion in the lower end of a tubular engagement part 132, and the lower face of the membrane valve body 132*e* forms the lower face of the enlarged-diameter portion. The membrane valve body 132*e* and the upper face of a base portion 124*d* in the lower part of a liquid cylinder 124A form a primary check valve.

The membrane valve body 132*e* works with the tubular engagement part 132 in the dispensing pump body 110 of the second embodiment, and while a nozzle head 122 is raised to its highest position, as shown in FIG. 4, the membrane valve body 132*e* is not in contact with the base portion 124*d* in the lower part of the liquid cylinder, and the primary check valve is always open. When the nozzle head 122 is pressed down, the tubular engagement part 132 is lowered together therewith, and the membrane valve body 132*e* at the bottom of the tubular engagement part 132 comes into contact with the upper face of the base portion 124*d* in the lower part of the liquid cylinder, covers the opening, and blocks the connection between the inside of the liquid chamber A and a tube body 112. Therefore, in the second embodiment, in which the membrane valve body 132*e* is disposed at the lower end of the tubular engagement part, the primary check valve is left open while the nozzle head 22 is raised to its highest position.

The dispensing pump body 210 in the third embodiment has an approximately funnel-shaped ball valve seat portion 232*e* in an enlarged-diameter portion in the lower end of a tubular engagement part 232, and the lower face of the ball valve seat portion 232*e* forms the lower face of the enlarged-diameter portion. A stainless-steel ball valve 230 is placed on the ball valve seat portion 232*e*, and a base portion 224*d* in the lower part of a liquid cylinder 224A, the valve seat portion 232*e*, and the stainless-steel ball valve 230 form a primary check valve.

The ball valve seat portion 232*e* works with the tubular engagement part 232 in the dispensing pump body 210 of the third embodiment, and while a nozzle head 222 is raised to its highest position as shown in FIG. 5, the lower end of the ball valve seat portion 232*e* is not in contact with the upper face of the base portion 224*d* of the liquid cylinder, and the primary check valve is left open regardless of the position of the stainless-steel ball valve 230. When the nozzle head 222 is pressed down further, the tubular engagement part 132 is lowered together therewith, and the lower end of the ball valve seat portion 232*e* comes into contact with the upper face of the base portion 224*d* in the lower part of the liquid cylinder. When the stainless-steel ball valve 230 comes into contact with the valve seat portion 232*e* in that state, the connection between the inside of the liquid chamber A and a tube body 212 is blocked. Alternatively, when the nozzle head 222 is raised in that state, the inside of the liquid chamber A is depressurized, moving the stainless-steel ball valve 230 upward, apart from the valve seat portion 232*e*, and opening the connection between the inside of the liquid chamber A and the tube body 212. Therefore, in the third embodiment, in which the ball valve seat portion 232*e* is disposed at the lower end of the tubular engagement part to work together therewith, the primary check valve is left open while the nozzle head 22 is raised to its highest position.

The second or third embodiment including the valve structured to work with the tubular engagement part can produce the same effect as the first embodiment without using a material having a specific gravity lower than general liquid preparations.

The other components of the dispensing pump body 10 in this embodiment will be described below.

An elastic valve body 34 made of a soft synthetic resin is disposed between the lower face of the outer periphery of the middle coupling portion 28*d* of the air piston 28 and the upper face of an annular protrusion portion 26*b* formed on the outer periphery of the liquid piston 26. With respect to an air intake 28*g* disposed in the middle coupling portion 28*d* of the air piston 28 and the entry side (on the side of the air chamber B) of the air passage D formed in the press-fit joint of the air piston 28 and the liquid piston 26, the elastic valve body 34 connects the air intake 28*g* only when the air chamber B is depressurized (serving as a primary intake valve) and connects the air chamber B and the air passage D only when the air chamber B is pressurized (serving as a secondary intake valve).

The elastic valve body 34 has a thin annular outward valve portion 34*b* which extends outward from the vicinity of the lower end of a cylindrical tubular base 34*a* and a thin annular inward valve portion 34*c* which extends inward from the vicinity of the lower end of the tubular base 34*a*, the two valve portions being integrally formed with respect to the tubular base 34*a*. The tubular base 34*a* is secured by the middle coupling portion 28*d* of the air piston 28. The elastic valve body 34 is disposed in the upper part of the air chamber B such that the outer edge of the upper face of the outward valve portion 34*b* comes into contact with the lower face (on the side of the air chamber B) of the middle coupling portion 28*d* on the outer side of the air intake 28*g* in the radial direction and the inner edge of the lower face of the inward valve portion 34*c* comes into contact with the upper face of the annular protrusion portion 26*b* formed on the liquid piston 26. The space between the inward valve portion 34*c* of the elastic valve body 34 and the lower face of the middle coupling portion 28*d* disposed above the inward valve portion 34*c* is sufficient for allowing upward displacement of the inward valve portion 34*c*.

When the air chamber B is pressurized or is under normal pressure, the outer edge of the outward valve portion 34*b* comes into contact with the lower face of the middle coupling portion 28*d*, and the primary intake valve, which opens or closes the air intake 28*g*, closes the air intake 28*g*, which forms a connection path between the air chamber B and the outside air. If the air chamber B is depressurized here by an upward movement of the air piston 28, the outward valve portion 34*b* of the elastic valve body 34 is displaced (elastically deformed) downward to separate from the lower face of the middle coupling portion 28*d* and opens the air intake 28*g*.

When the air chamber B is depressurized or is under normal pressure, the inner edge of the inward valve portion 34*c* comes into contact with the annular protrusion portion 26*b* of the liquid piston 26, and the secondary intake valve, which controls the connection between the air chamber B and the air passage D, closes the entry to the air passage D from the air chamber B. When the air piston 28 is lowered to pressurize the air chamber B, the inward valve portion 34*c* of the elastic valve body 34 is displaced (elastically deformed) upward to separate from the annular protrusion portion 26*b* and opens the entry of the air passage D. The elastic valve body 34 here closes the entry to the air passage D from the air chamber B when the air chamber B is depressurized or is under normal pressure, which means that the entry to the air passage D from the air chamber B is closed while the nozzle head 22 is raised together with the air piston 28. The volume of the air passage D is not changed by the upward movement of the nozzle head 22, and the normal pressure of the air passage D is maintained while the nozzle head is being raised.

The nozzle head 22 is secured to the liquid piston 26 and the air piston 28 from above. The outer tubular portion 22*b* of the nozzle head 22 has a space where air can pass, and is guided by the end of the upright wall 20*c* of the base cap portion 20. An air hole 24*g* is provided in the upper part of the cylinder wall of the air cylinder 24B to guide the outside air into the head space (space above the surface of the foaming liquid) in the container body through the space between the inner edge of the upright wall 20*c* of the base cap 20 and the outer periphery of the inner tubular portion 22*a* of the nozzle head 22. The sliding seal portion 28*a* of the air piston 28 has a shallow U-shaped cross section to block the air hole 24*g* by covering it from the inside when the air piston 28 is in its highest position. When the air piston 28 is lowered, the air hole 24*g* is released from the sliding seal portion 28*a* and connects the outside air and the inside of the container body.

Secondary Check Valve

The rod-shaped valve body 38 made of a synthetic resin is disposed in the space formed by the liquid piston 26 and the liquid cylinder 24A in the dispensing pump body 10 of this embodiment. The tubular engagement part 32 made of a synthetic resin that controls the upward movement of the rod-shaped valve body 38 is disposed in the lower space in the liquid cylinder 24A. The exit at the upper end of the liquid piston 26 is blocked when the catch portion 38*a* disposed in the end of the rod-shaped valve body 38 comes into contact with the funnel-shaped liquid-chamber valve seat portion 26*a* disposed at the upper end of the liquid piston 26. When the nozzle head 22 is lowered, the liquid-chamber valve seat portion 26*a* is lowered, separating the catch portion 38*a* of the rod-shaped valve body 38 and the liquid-chamber valve seat portion 26*a*, and the exit at the upper end of the liquid piston 26 is opened.

The approximately-cone-shaped catch portion 38*a* is formed on the outer periphery around the upper end of the rod-shaped valve body 38, the largest outer diameter of the catch portion 38*a* being larger than the smallest inner diameter of the approximately-funnel-shaped liquid-chamber valve seat member 26*a* formed on the inner periphery around the upper end of the liquid piston 26, and the catch portion 38*a* of the rod-shaped valve body 38 and the liquid-chamber valve seat member 26*a* of the liquid piston 26 form a secondary check valve. While the nozzle head 22 is pressed down, the catch portion 38*a* and the liquid-chamber valve seat member 26*a* do not come into contact with each other, and the exit at the upper end of the liquid piston 26 is left open. As the nozzle head 22 is raised, the liquid-chamber valve seat member 26*a* rises to come into contact with the catch portion 38*a* and blocks the exit at the upper end of the liquid piston 26.

In the small-diameter lower end of the rod-shaped valve body 38, a large-diameter portion 38*b* is disposed to form a step with respect to the upper part, and the lower end of the portion is tapered. A ring-like inward projection 32*d* disposed at the upper end of the tubular engagement part 32 engages with the large-diameter portion 38*b* from the outer side to allow vertical movements only in a given range. The rod-shaped valve body 38 is held such that it can move up and down just in a given range with respect to the liquid cylinder 24A, and the rod-shaped valve body 38 limits the highest position of the liquid piston 26. It is preferred that the small-diameter lower end of the rod-shaped valve body 38 generate frictional resistance that will not disturb the vertical movement while it is held by the tubular engagement part 32. In that structure, as the nozzle head 22 is raised, the liquid-chamber valve seat portion 26*a* moves up and comes into contact with the catch portion 38*a*, and the catch portion 38*a* is pressed against the liquid-chamber valve seat portion 26*a* by frictional resistance, so that the catch portion 38*a* in contact with the valve seat portion 26*a* will not be lifted, and a preferred sealed state can be produced.

The tubular engagement part 32 is disposed such that it can be brought into contact with the upper face of the base portion 24*d* formed in the lower part of the liquid cylinder 24A, and the annular support 32*a* is formed to jut out in the lower end portion of the tubular engagement part 32. An open tubular portion 32*b* having a plurality of vertical open grooves or dividing grooves provided radially to form liquid passages is formed above the annular support 32*a*, and a nonporous cylindrical portion 32*c* is formed above the open tubular portion 32*b*. The ring-like inward projection 32*d* is formed at the upper end of the nonporous cylindrical portion 32*c*. The annular support 32*a* formed at the lower end supports the lower end of the coil spring.

The ring-like inward projection 32*d* formed at the upper end of the tubular engagement part 32 engages with the large-diameter portion 38*b* formed at the lower end of the rod-shaped valve body 38 and prevents the rod-shaped valve body 38 from moving upward, and, at the same time, the catch portion 38*a* of the rod-shaped valve body 38 comes into contact with the liquid-chamber valve seat portion 26*a* of the liquid piston 26, limiting the highest position of the liquid piston 26 pushed up by the coil spring. The inner portion of the annular support 32*a* disposed at the lower end of the tubular engagement part 32 functions as a ball valve catch portion and prevents the ball valve 30 of the primary check valve from being raised, consequently limiting the distance by which the ball valve 30 can be lifted by buoyancy.

The tubular engagement part 32 is disposed such that it can move up and down in the given range with respect to the liquid cylinder 24A. More specifically, the lower face of the annular support 32*a* of the tubular engagement part 32 can come into contact with the upper face of the base portion 24*d* in the lower part of the liquid cylinder 24A but is not secured to the upper face of the base portion 24*d*, and therefore, the entire tubular engagement part 32 can move up and down in the given range with respect to the liquid cylinder 24A.

With the tubular engagement part 32 that can move up and down in the given range, when the nozzle head 22 is brought up further above the top dead point of the pump (position where the coil spring starts being compressed) as shown in FIG. 1, the liquid piston 26, the coil spring, and the tubular engagement part 32 move upward together with the nozzle head 22; the lower face of the annular support 32*a* of the tubular engagement part 32 is separated from the upper face of the base portion 24*d* formed in the lower part of the liquid cylinder 24A; and a given distance is provided between the lower face of the annular support 32*a* and the upper face of the annular base portion 24*d*.

When the nozzle head 22 is pressed down to compress the coil spring to lower the liquid piston 26, the catch portion 38*a* of the rod-shaped valve body 38 is separated from the liquid-chamber valve seat portion 26*a* in the secondary check valve, opening the exit at the upper end of the liquid piston 26. If the nozzle head 22 is brought upward further above the top dead point of the pump, the lower face of the annular support 32*a* of the tubular engagement part 32 is separated from the upper face of the base portion 24*d* in the lower part of the liquid cylinder 24A, and a given distance is provided between them. Then, even when the nozzle head 22 is pressed down, the coil spring will not be compressed before the lower face of the annular support 32*a* comes into contact with the upper face of the base portion 24*d*, and the exit at the upper end of the liquid piston 26 will not open during that period. Therefore, if the nozzle head 22 is raised forcibly, for example, by disposing a stopper on the outer side of the upright wall 20*c*, slight downward movements of the nozzle head 22 during transportation or the like will not immediately open the secondary check valve, and unintentional leakage of the liquid can be avoided (refer to Patent Literature 1).

As the primary check valve, conventional pump-dispensing containers generally use a ball valve having a higher specific gravity than general liquid preparations, such as a stainless-steel ball valve. If that type of stainless-steel ball valve were used as the primary check valve in the pump-dispensing container having the above-described structure, for example, when the nozzle head 22 is brought upward further above the top dead point as the pump while the liquid chamber A is filled with a liquid preparation, the stainless-steel ball would be lowered by gravity, and the primary check valve would be closed. To lower the nozzle head 22 to push out the liquid preparation again in that state, in which both the primary check valve and the secondary check valve are closed, a large force should be applied to press the nozzle head 22 downward to forcibly pressurize the liquid preparation filling the liquid chamber until the secondary check valve starts opening. If a ball valve having a higher specific gravity than general liquid preparations, such as a stainless-steel ball valve, is used, a large force might be required to press down the nozzle head 22 first from the raised position.

The pump-dispensing container in the first embodiment of the present invention uses the ball valve 30 made of a polypropylene resin having a specific gravity of 0.90 to 0.91, for example, and the ball valve 30 having a smaller specific gravity than general liquid preparations is always lifted by buoyancy and does not come into contact with the valve seat portion 24*e*, leaving the primary check valve open, while the liquid cylinder 24A is filled with a liquid preparation. When the nozzle head 22 is brought up by a force exceeding the force exerted by the coil spring while the liquid chamber A is filled with a liquid preparation, the primary check valve is left open. When the nozzle head 22 is pressed down to push out the liquid preparation again in that state, a part of the liquid preparation filling the liquid chamber A flows back into the container body through the primary check valve, which is left open, and the resistance met in pressing down the nozzle head 22 first from its raised position becomes very small.

Operation States of the Pump-Dispensing Container

Operation states of the dispensing pump body in this embodiment will be described next.

Figure 2:
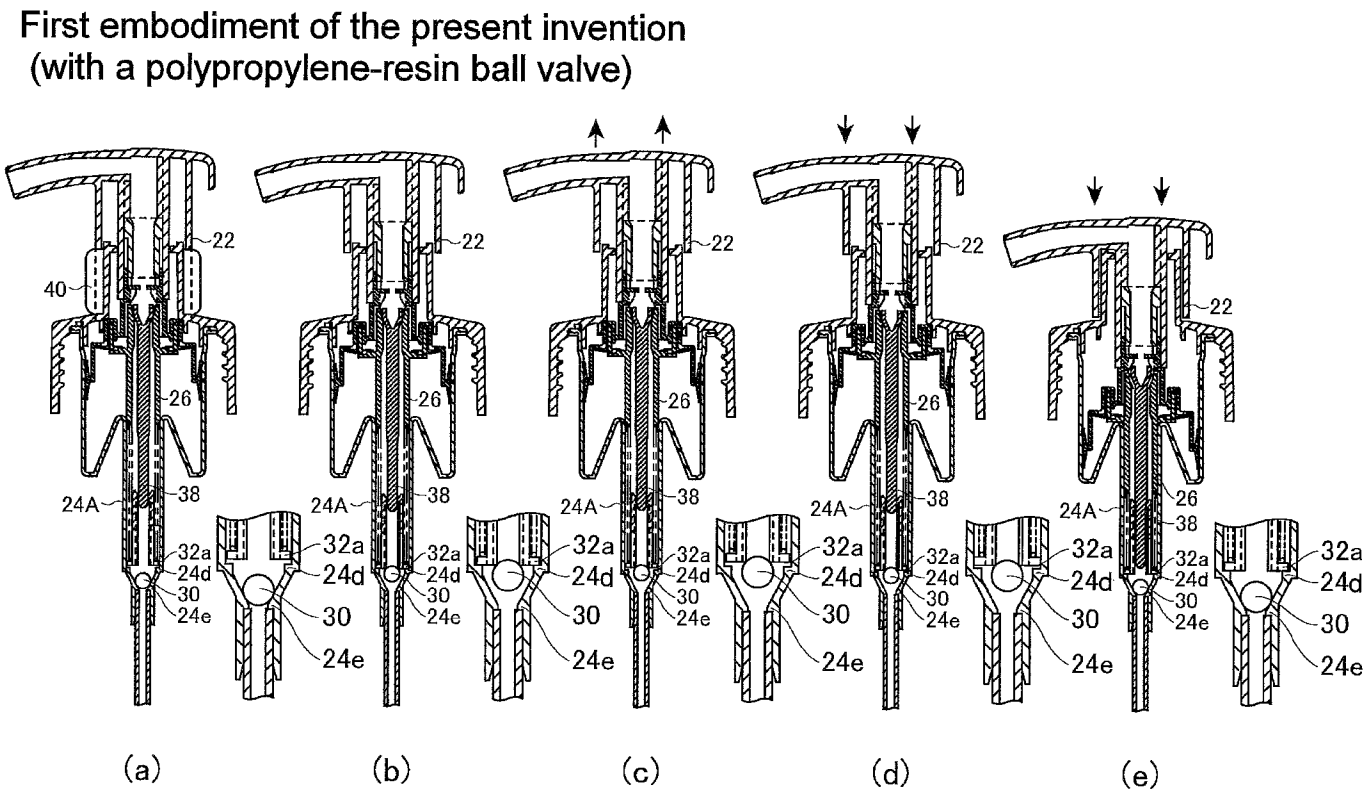
FIG. 2 is a view illustrating operation states of the pump-dispensing container according to the first embodiment of the present invention (with a polypropylene-resin ball valve) when the nozzle head is moved.
Figure 3:
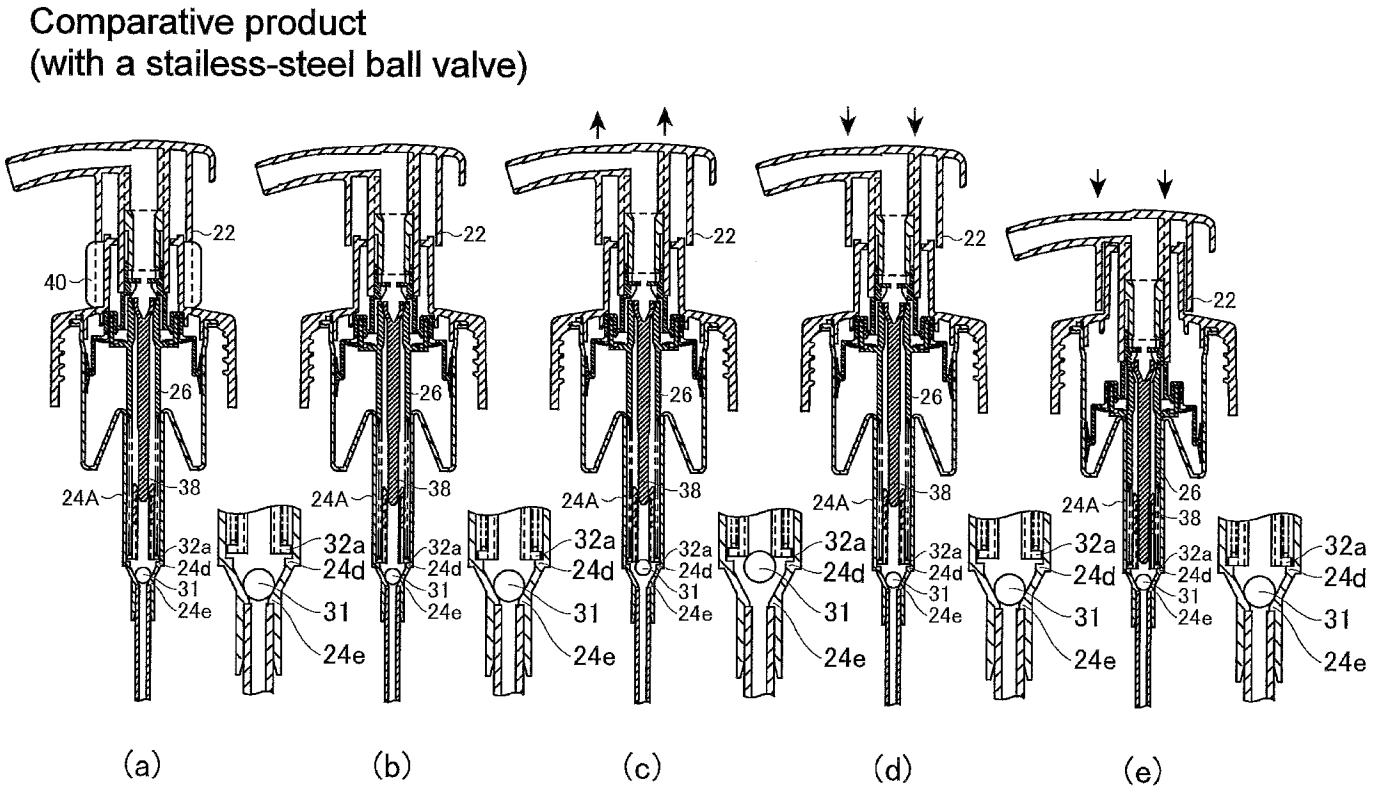
FIG. 3 is a view illustrating (for comparison) operation states of a conventional pump-dispensing container (using a stainless-steel ball valve) when the nozzle head is moved.

FIG. 2 illustrates operation states of the pump-dispensing container (using the polypropylene-resin ball valve 30) according to the first embodiment of the present invention when the nozzle head is moved. FIG. 3 illustrates (for comparison) operation states of a conventional pump-dispensing container (using a stainless-steel ball valve 31).

In the pump-dispensing container in this embodiment, the container body is filled with a liquid when the container is assembled to a finished product; the liquid piston 26 is raised to the top dead point of the pump by the force exerted by the coil spring, as shown in FIG. 2(*a*), immediately before the user starts using the product; and a separate stopper 40 is inserted between the nozzle head 22 and the base cap 20, with the nozzle head 22 brought upward further above the top dead point, and the nozzle head 22 is kept in its highest position. As the nozzle head 22 is brought up, since the liquid piston 26, the coil spring, and the tubular engagement part 32 are also brought up, the lower face of the annular support 32*a* of the tubular engagement part 32 is separated from the upper face of the base portion 24*d* in the lower part of the liquid cylinder 24A, and a given distance is provided between them. In that state, the stopper 40 prevents the nozzle head from moving down, and even when a large force applied to the nozzle head 22 moves it down slightly, the secondary check valve will not open immediately and the liquid will not leak.

In the state shown in FIG. 2(*a*), the polypropylene-resin-based ball valve 30 in the primary check valve is in contact with the valve seat portion 24*e* due to gravity, and the entry to the liquid chamber A at the lower end is closed. As for the secondary check valve, since the liquid piston 26 is raised to its highest position by a force exerted by the coil spring, the rod-shaped valve body 38 blocks the exit of the liquid piston 26 at the upper end. Both the primary check valve and the secondary check valve in the pump-dispensing container are closed in the factory-set state of the pump-dispensing container.

When the user begins to use the container in the state shown in FIG. 2(*a*) and repeatedly presses down the nozzle head 22, just air is sent to the discharge opening 22*c* from the liquid chamber A, which is not filled with the liquid initially. At the same time, the liquid is sucked into the liquid chamber A from the container body, and the liquid preparation is gradually sent into the liquid chamber A from the container body. When the liquid chamber A is filled with the liquid preparation, as shown in FIG. 2(*b*), the ball valve 30 having a lower specific gravity than general liquid preparations is lift up by buoyancy and is separated from the valve seat portion 24*e*, and the primary check valve is released. On the other hand, the secondary check valve is not released before the nozzle head is pressed down to compress the coil spring. Even when the container rolls over to its side in the state shown in FIG. 2(*b*), the secondary check valve prevents the liquid from leaking out from the liquid chamber A.

When the nozzle head 22 is brought up above the top dead point of the pump from the state shown in FIG. 2(*b*), the lower face of the annular support 32*a* of the tubular engagement part 32 is separated from the upper face of the base portion 24*d* in the lower part of the liquid cylinder 24A, as shown in FIGS. 2(*c*) and 2(*d*). Accordingly, even when the nozzle head 22 is pressed down slightly by a small pressure applied to the nozzle head 22 from above, by vibration of the container, or for some reason, the secondary check valve will not be released immediately until the lower face of the annular support 32*a* comes into contact with the upper face of the base portion 24*d* to bring the nozzle head to the top dead point of the pump, and unintentional leakage of the liquid can be prevented.

In the pump-dispensing container that uses the conventional stainless-steel ball valve 31, after the nozzle head 22 is brought up, the ball valve 31 is lowered by gravity because it has a higher specific gravity than general liquid preparations, and the primary check valve is closed, as shown in FIG. 3(*d*), for example. To press down the nozzle head 22 to push out the liquid preparation again in that state, a large force must be applied to press down the nozzle head 22 by the distance provided between the lower face of the annular support 32*a* of the tubular engagement part 32 and the upper face of the base portion 24*d* in the lower part of the liquid cylinder 24A because both the primary check valve and the secondary check valve are closed. Since the primary check valve and the secondary check valve are both closed, there is no space where the liquid preparation filling the liquid chamber A can flow out. Therefore, the nozzle head 22 must be forced down to pressurize the liquid preparation contained in the liquid chamber A to bring the lower face of the annular support 32*a* into contact with the upper face of the base portion 24*d* and to compress the coil spring until the secondary check valve is released.

In contrast, since the pump-dispensing container in this embodiment uses the ball valve 30 made of a polypropylene resin having a specific gravity of 0.90 to 0.91, while the liquid chamber A is filled with a liquid preparation, the ball valve 30 having a lower specific gravity than general liquid preparations is always lifted up by buoyancy, and the primary check valve is left open, as shown in FIG. 2(*d*). Therefore, when a force is applied to press down the nozzle head 22 to push out the liquid preparation again after the nozzle head 22 is brought up, a part of the liquid preparation filling the liquid chamber A flows back into the container body through the primary check valve, and resistance met in pressing down the nozzle head 22 is very small.

Further pressing down of the nozzle head 22 causes the liquid preparation to flow back, pressing down the ball valve 30, and when the hydraulic pressure due to the liquid preparation in the liquid chamber A exceeds the buoyant force of the ball valve 30, the ball valve 30 is pressed against the valve seat portion 24*e* in the lower part, and the primary check valve closes, as shown in FIG. 2(*e*). When the primary check valve is closed by the hydraulic pressure in the liquid chamber A and when the lower face of the annular support 32*a* comes into contact with the upper face of the base portion 24*d* and the coil spring is compressed to release the secondary check valve, the liquid in the liquid chamber A is forced out through the secondary check valve into the nozzle head 22 and is discharged from the discharge opening 22*c*. The pump-dispensing container in this embodiment allows the liquid to be discharged by applying a light force even when the nozzle head 22 is pressed down for the first time from its raised position and makes it easy to control the amount of liquid to be discharged by adjusting the distance by which the nozzle head is lowered.

Figure 6:
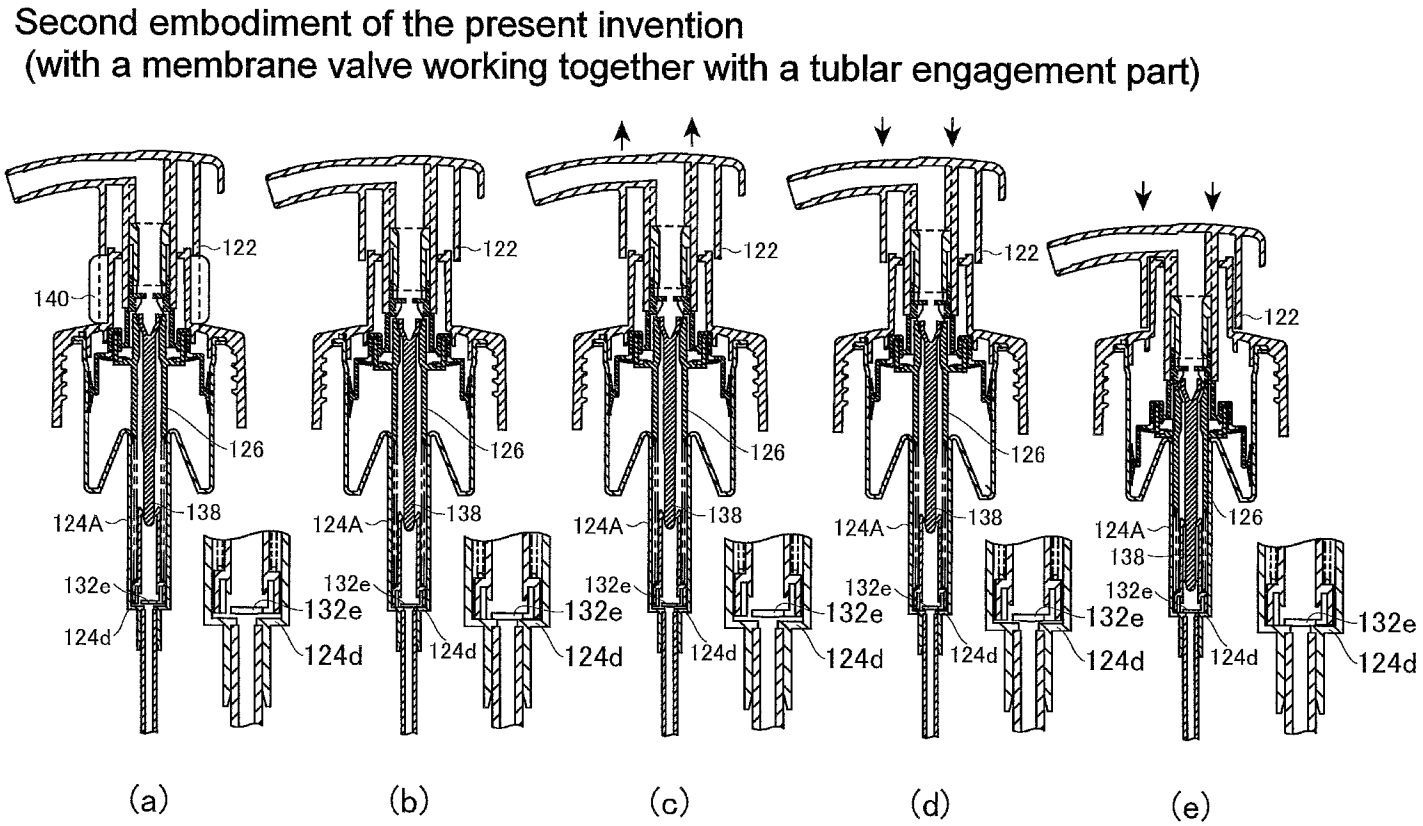
FIG. 6 is a view illustrating operation states of the pump-dispensing container according to the second embodiment of the present invention (using a membrane valve working together with a tubular engagement part) when the nozzle head is moved.
Figure 7:
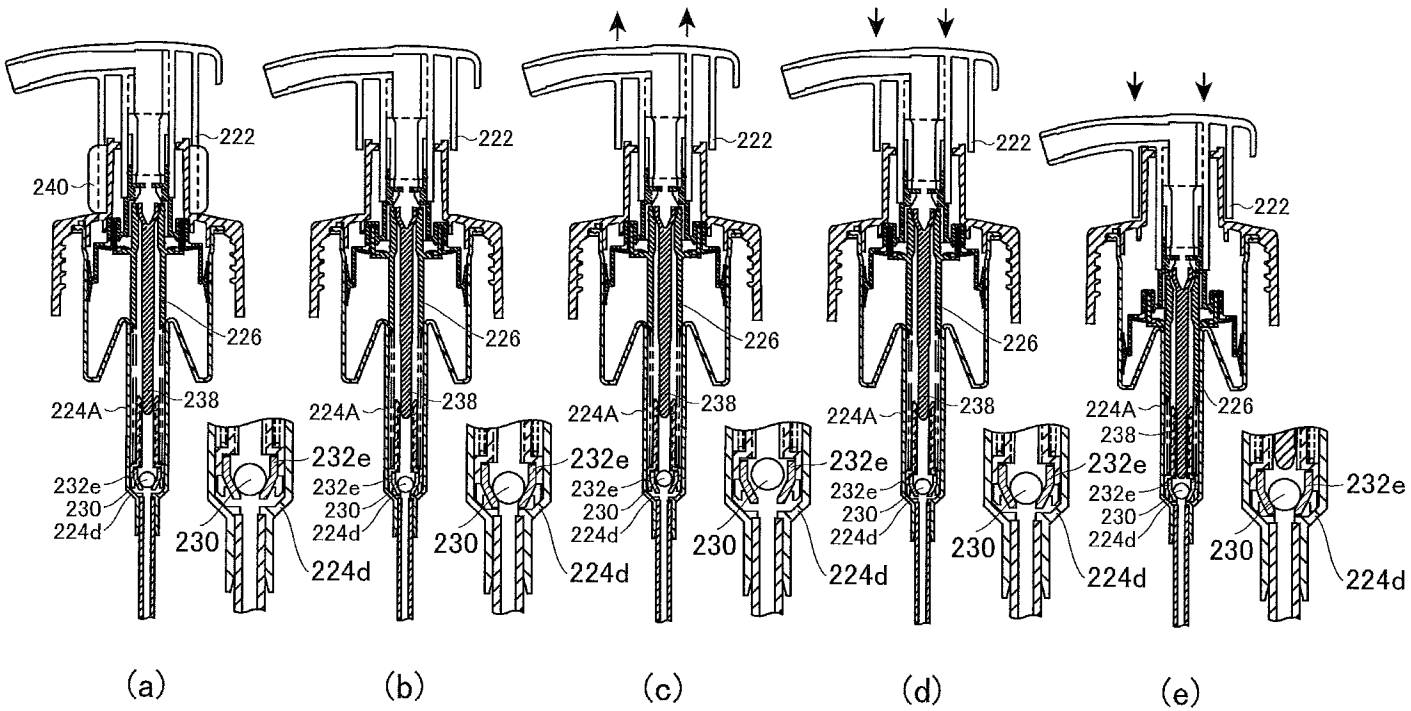
FIG. 7 is a view illustrating operation states of the pump-dispensing container according to the third embodiment of the present invention (using a stainless-steel ball valve working together with a tubular engagement part) when the nozzle head is moved.

FIG. 6 illustrates operation states of the pump-dispensing container (using the membrane valve body 132*e* working together with the tubular engagement part) according to the second embodiment of the present invention, and FIG. 7 illustrates operation states of the pump-dispensing container (using the ball valve seat portion 232*e* working together with the tubular engagement part) according to the third embodiment of the present invention.

While the nozzle head 122 in the pump-dispensing container according to the second embodiment is held to its highest position, as shown in FIG. 6(*a*), before the user begins using the container, since the liquid piston 126, the coil spring, and the tubular engagement part 132 are brought up together with the nozzle head 122, the membrane valve body 132*e* disposed at the lower end of the tubular engagement part 132 is separated from the upper face of the base portion 124*d* in the lower part of the liquid cylinder 124A, a given distance is provided between them, and the primary check valve is left open. On the other hand, the liquid piston 126 is held to its highest position by the force exerted by the coil spring, the rod-shaped valve body 138 closes the exit at the upper end of the liquid piston 126, and the secondary check valve is closed.

When the nozzle head 122 is pressed down repeatedly from the state shown in FIG. 6(*a*), the liquid preparation in the container is sent into the liquid chamber A. When the nozzle head 122 is pressed down from its highest position shown in FIG. 6(*a*), the tubular engagement part 132 is also lowered, bringing the membrane valve body 132*e* at the lower end of the tubular engagement part into contact with the upper face of the base portion 124*d* in the lower part of the liquid cylinder, blocking the connection between the inside of the liquid chamber A and the tube body 112, and closing the primary check valve, as shown in FIG. 6(*b*).

When the nozzle head 122 is brought upward from the state shown in FIG. 6(*b*), the membrane valve body 132*e* is separated from the upper face of the base portion 124*d* in the lower part of the liquid cylinder, and the primary check valve is released, as shown in FIGS. 6(*c*) and 6(*d*). If a force is applied to lower the nozzle head 122 to push out the liquid preparation again after the nozzle head 122 is brought up to its highest position, part of the liquid preparation filling the liquid chamber A flows back into the container body because the primary check valve is left open as shown in FIG. 6(*d*), and resistance met in pressing down the nozzle head 122 is very small.

When the nozzle head 122 is kept pressed down further, the membrane valve body 132*e* comes in contact with the upper face of the base portion 124*d* in the lower part of the liquid cylinder and blocks the connection between the inside of the liquid chamber A and the tube body 112, causing the primary check valve to close, as shown in FIG. 6(*e*). Accordingly, the liquid in the liquid chamber A goes through the released secondary check valve and is discharged from the discharge opening 122*c* of the nozzle head 122.

When the nozzle head 222 in the pump-dispensing container in the third embodiment is brought up to its highest position, the tubular engagement part 232 is also held up, and the lower end of the ball valve seat portion 232*e* provided in the lower end of the tubular engagement part is not in contact with the upper face of the base portion 224*d* in the lower part of the liquid cylinder 224A, as shown in FIG. 7(*a*), and the primary check valve is released, as in the second embodiment. On the other hand, the rod-shaped valve body 238 is raised by the force exerted by the coil spring and blocks the exit at the upper end of the liquid piston 226, and the secondary check valve is closed.

When the nozzle head 222 is repeatedly pressed down from the state shown in FIG. 7(*a*), the liquid preparation in the container is sent into the liquid chamber A. However, as in the second embodiment, when the nozzle head 222 is pressed down from its highest position shown in FIG. 7(*a*), the tubular engagement part 232 is also lowered, and the ball valve seat portion 232*e* at the lower end of the tubular engagement part 232 comes into contact with the upper face of the base portion 224*d* in the lower part of the liquid cylinder 224A and blocks the connection between the inside of the liquid chamber A and the tube body 212, as shown in FIG. 7(*b*), and the primary check valve is closed.

When the nozzle head 222 is brought up further from the state shown in FIG. 7(*b*), the ball valve seat portion 232*e* is separated from the base portion 224*d* in the lower part of the liquid cylinder, as shown in FIGS. 7(*c*) and 7(*d*), and the primary check valve is released regardless of the position of the ball valve 230. When a force is applied to press down the nozzle head 222 to push out the liquid preparation again after the nozzle head 222 is brought up to its highest position, part of the liquid preparation filling the liquid chamber A flows back into the container body because the primary check valve is left open, as shown in FIG. 7(*d*), and resistance met in pressing down the nozzle head 222 is very small.

When the nozzle head 222 is kept pressed down further, the ball valve seat portion 232*e* comes into contact with the base portion 224*d* in the lower part of the liquid cylinder, and the ball valve 230 is pressed against the valve seat portion 232*e* by the hydraulic pressure of the liquid preparation in the liquid chamber A, consequently blocking the connection between the inside of the liquid chamber A, as shown in FIG. 7(*e*), and the tube body 212, that is, closing the primary check valve. Accordingly, the liquid in the liquid chamber A goes through the released secondary check valve and is discharged from the discharge opening 222*c* of the nozzle head 222.

Embodiments of the pump-dispensing container according to the present invention have been described above, but the present invention is not limited to the specific structures indicated in the embodiments. The pump-dispensing containers in the embodiments are foam dispensing containers, which mix air and a foaming liquid in the container and push it out in the form of foam, but the present invention is not limited to those types of foam dispensing containers and can be applied to liquid dispensing containers that discharge the liquid in the container bodies. The other pump structures are not limited to those indicated in the embodiments and may also be implemented by other conventionally known pump structures. The other components can be modified appropriately in accordance with specific uses.

What is claimed is:

1. A pump-dispensing container including a container body and a dispensing pump body mounted on the opening of the container body, discharging a liquid contained in the container body from a discharge opening provided in a nozzle head portion disposed in the upper part of the dispensing pump body when the nozzle head portion is moved up and down, wherein the dispensing pump body includes: a tubular liquid cylinder portion which can be connected to the inside of the container body; a primary check valve which can open and close the connection between the liquid cylinder portion and the inside of the container body; a liquid piston portion which is a tubular member that can be moved up and down together with the nozzle head portion, the outer surface of the lower end being in sliding contact with the inner wall of the liquid cylinder portion, a space enclosed together with the liquid cylinder portion being provided as a liquid chamber, and the liquid piston portion being able to be connected to the inside of the nozzle head portion through an upper open end; a rod-shaped valve body which is a rod-shaped member disposed in the space enclosed by the liquid cylinder portion and the liquid piston portion, the upper end penetrating the upper open end of the liquid piston portion, the penetrated upper end having an enlarged-diameter portion having an outer diameter larger than the diameter of the open end of the liquid piston portion, and the rod-shaped valve body forming a secondary check valve which can open and close the connection between the inside of the liquid piston portion and the inside of the nozzle head portion by blocking the open end with the enlarged-diameter portion in contact with the open end of the liquid piston portion or by releasing the open end by separating the enlarged-diameter portion and the open end; a tubular engagement portion which is a tubular member engaging with the lower end of the rod-shaped valve body from the outer side, the lower face of an enlarged-diameter portion that extends outward in the lower end of the tubular member being able to be in contact with the upper face of a base portion extending inward from the edge of the bottom of the liquid cylinder portion; a spring portion which comes between the lower end of the liquid piston portion and the upper face of the enlarged-diameter portion of the tubular engagement portion and exerts force in a direction in which the distance between the liquid piston portion and the tubular engagement portion is increased; and a tubular nozzle head portion which has a discharge opening in the end and which can be connected to the inside of the liquid piston portion through the upper open end, wherein the nozzle head portion is brought up further above the top dead point, where the coil spring starts being compressed by moving down the nozzle head portion, the liquid piston portion, the spring portion, and the tubular engagement portion are brought up together with the nozzle head portion, and the lower face of the enlarged-diameter portion of the tubular engagement portion is separated from the upper face of the base portion on the edge of the bottom of the liquid cylinder portion, providing a given distance between the lower face of the enlarged-diameter portion and the upper face of the base portion on the edge of the bottom, and allowing the tubular engagement portion to move up and down in a given range with respect to the liquid cylinder portion, and the primary check valve releases the connection between the liquid cylinder portion and the inside of the container body in the state in which the liquid chamber is filled with a desired liquid and the nozzle head portion is brought up to the highest unactuated position, wherein the primary check valve includes a ball having a specific gravity lower than 1.00 and a valve seat portion provided in the liquid cylinder portion and having a smaller diameter than the ball.

2. The pump-dispensing container of claim 1, wherein the ball used in the primary check valve is a ball made of a resin having a specific gravity lower than 1.00.

3. The pump-dispensing container of claim 2, wherein the ball used in the primary check valve is made of a resin chosen from among polyethylene, polypropylene, and ethylene-vinyl acetate copolymer.

4. The pump-dispensing container of claim 2, including a ball catch portion to prevent the ball from rising.

5. The pump-dispensing container of claim 3, including a ball catch portion to prevent the ball from rising.

6. The pump-dispensing container of claim 1, including a ball catch portion to prevent the ball from rising.

7. A pump-dispensing container including a container body and a dispensing pump body mounted on the opening of the container body, discharging a liquid contained in the container body from a discharge opening provided in a nozzle head portion disposed in the upper part of the dispensing pump body when the nozzle head portion is moved up and down, wherein the dispensing pump body includes: a tubular liquid cylinder portion which can be connected to the inside of the container body; a primary check valve which can open and close the connection between the liquid cylinder portion and the inside of the container body; a liquid piston portion which is a tubular member that can be moved up and down together with the nozzle head portion, the outer surface of the lower end being in sliding contact with the inner wall of the liquid cylinder portion, a space enclosed together with the liquid cylinder portion being provided as a liquid chamber, and the liquid piston portion being able to be connected to the inside of the nozzle head portion through an upper open end; a rod-shaped valve body which is a rod-shaped member disposed in the space enclosed by the liquid cylinder portion and the liquid piston portion, the upper end penetrating the upper open end of the liquid piston portion, the penetrated upper end having an enlarged-diameter portion having an outer diameter larger than the diameter of the open end of the liquid piston portion, and the rod-shaped valve body forming a secondary check valve which can open and close the connection between the inside of the liquid piston portion and the inside of the nozzle head portion by blocking the open end with the enlarged-diameter portion in contact with the open end of the liquid piston portion or by releasing the open end by separating the enlarged-diameter portion and the open end; a tubular engagement portion which is a tubular member engaging with the lower end of the rod-shaped valve body from the outer side, the lower face of an enlarged-diameter portion that extends outward in the lower end of the tubular member being able to be in contact with the upper face of a base portion extending inward from the edge of the bottom of the liquid cylinder portion; a spring portion which comes between the lower end of the liquid piston portion and the upper face of the enlarged-diameter portion of the tubular engagement portion and exerts force in a direction in which the distance between the liquid piston portion and the tubular engagement portion is increased; and a tubular nozzle head portion which has a discharge opening in the end and which can be connected to the inside of the liquid piston portion through the upper open end, wherein the nozzle head portion is brought up further above the top dead point, where the coil spring starts being compressed by moving down the nozzle head portion, the liquid piston portion, the spring portion, and the tubular engagement portion are brought up together with the nozzle head portion, and the lower face of the enlarged-diameter portion of the tubular engagement portion is separated from the upper face of the base portion on the edge of the bottom of the liquid cylinder portion, providing a given distance between the lower face of the enlarged-diameter portion and the upper face of the base portion on the edge of the bottom, and allowing the tubular engagement portion to move up and down in a given range with respect to the liquid cylinder portion, and the primary check valve releases the connection between the liquid cylinder portion and the inside of the container body in the state in which the liquid chamber is filled with a desired liquid and the nozzle head portion is brought up to the highest unactuated position, wherein the primary check valve includes a membrane valve body disposed in the enlarged- diameter portion in the lower end of the tubular engagement portion, and the base portion on the edge of the bottom of the liquid cylinder portion.

8. A pump-dispensing container including a container body and a dispensing pump body mounted on the opening of the container body, discharging a liquid contained in the container body from a discharge opening provided in a nozzle head portion disposed in the upper part of the dispensing pump body when the nozzle head portion is moved up and down, wherein the dispensing pump body includes: a tubular liquid cylinder portion which can be connected to the inside of the container body; a primary check valve which can open and close the connection between the liquid cylinder portion and the inside of the container body; a liquid piston portion which is a tubular member that can be moved up and down together with the nozzle head portion, the outer surface of the lower end being in sliding contact with the inner wall of the liquid cylinder portion, a space enclosed together with the liquid cylinder portion being provided as a liquid chamber, and the liquid piston portion being able to be connected to the inside of the nozzle head portion through an upper open end; a rod-shaped valve body which is a rod-shaped member disposed in the space enclosed by the liquid cylinder portion and the liquid piston portion, the upper end penetrating the upper open end of the liquid piston portion, the penetrated upper end having an enlarged-diameter portion having an outer diameter larger than the diameter of the open end of the liquid piston portion, and the rod-shaped valve body forming a secondary check valve which can open and close the connection between the inside of the liquid piston portion and the inside of the nozzle head portion by blocking the open end with the enlarged-diameter portion in contact with the open end of the liquid piston portion or by releasing the open end by separating the enlarged-diameter portion and the open end; a tubular engagement portion which is a tubular member engaging with the lower end of the rod-shaped valve body from the outer side, the lower face of an enlarged-diameter portion that extends outward in the lower end of the tubular member being able to be in contact with the upper face of a base portion extending inward from the edge of the bottom of the liquid cylinder portion; a spring portion which comes between the lower end of the liquid piston portion and the upper face of the enlarged-diameter portion of the tubular engagement portion and exerts force in a direction in which the distance between the liquid piston portion and the tubular engagement portion is increased; and a tubular nozzle head portion which has a discharge opening in the end and which can be connected to the inside of the liquid piston portion through the upper open end, wherein the nozzle head portion is brought up further above the top dead point, where the coil spring starts being compressed by moving down the nozzle head portion, the liquid piston portion, the spring portion, and the tubular engagement portion are brought up together with the nozzle head portion, and the lower face of the enlarged-diameter portion of the tubular engagement portion is separated from the upper face of the base portion on the edge of the bottom of the liquid cylinder portion, providing a given distance between the lower face of the enlarged-diameter portion and the upper face of the base portion on the edge of the bottom, and allowing the tubular engagement portion to move up and down in a given range with respect to the liquid cylinder portion, and the primary check valve releases the connection between the liquid cylinder portion and the inside of the container body in the state in which the liquid chamber is filled with a desired liquid and the nozzle head portion is brought up to the highest unactuated position, wherein the primary check valve includes a ball and a valve seat portion provided in the enlargement-diameter portion in the lower end of the tubular engagement portion and having a smaller diameter than the ball.

* * * * *